US008328125B2

(12) United States Patent
Solomon et al.

(10) Patent No.: US 8,328,125 B2
(45) Date of Patent: Dec. 11, 2012

(54) GEARBOX ASSEMBLY FOR GYRATORY AND CONE CRUSHERS

(75) Inventors: Mark Solomon, Orefield, PA (US); Eduardo O. Hurtado, Bethlehem, PA (US); K. Chris Littleford, Scotrun, PA (US); Charles Morgan, Pen Argyl, PA (US)

(73) Assignee: FLSmidth A/S (DK)

( * ) Notice: Subject to any disclaimer, the term of this patent is extended or adjusted under 35 U.S.C. 154(b) by 140 days.

(21) Appl. No.: 12/765,075

(22) Filed: Apr. 22, 2010

(65) Prior Publication Data

US 2011/0259984 A1 Oct. 27, 2011

(51) Int. Cl.
*B02C 2/00* (2006.01)

(52) U.S. Cl. ..... 241/30; 241/207

(58) Field of Classification Search ..... 241/207–216, 241/30

See application file for complete search history.

(56) References Cited

U.S. PATENT DOCUMENTS 7,048,214 B2 * 5/2006 Johnson et al. ..... 241/65

* cited by examiner

*Primary Examiner* — Mark Rosenbaum

(74) *Attorney, Agent, or Firm* — Daniel DeJoseph; Aaron M. Pite; Jeffrey A. Sharp

(57) ABSTRACT

A gearbox assembly for a gyratory crusher and/or cone crusher, which includes a drive shaft having a rotational movement, and a drive shaft gear attached to a distal end of the drive shaft. The drive shaft gear imparts a rotational movement of the drive shaft to a first gearing assembly, the first gearing assembly imparting a second rotational movement to a second gearing assembly, the second gearing assembly imparting a third rotational movement of the second gearing assembly to drive a ring gear, and wherein the ring gear is attached to and rotates an eccentric assembly of the gyratory crusher and/or cone crusher. The cone crusher is preferably configured to crush rock, stone, ore or minerals. A method of making or retrofitting a crushing device such as, for example, a cone crusher or other gyratory crusher, is also provided.

19 Claims, 5 Drawing Sheets

GEARBOX ASSEMBLY FOR GYRATORY AND CONE CRUSHERS

FIELD OF INVENTION

The present invention relates to crushing devices and, more particularly, to a gearbox assembly for gyratory crushers and/or cone crushers.

BACKGROUND OF THE INVENTION

Crushing devices, such as cone crushers and gyratory crushers, are typically used to crush rock, ore or minerals. Crushers may form a circuit of a process configured to crush material from a first size to a smaller size. After the material is crushed, the material may be moved to a grinding circuit for grinding the material to an even smaller size.

One type of crushing device that is commonly used is a cone crusher, which typically breaks rock by squeezing the rock between an eccentrically gyrating spindle and an enclosing concave hopper. As rock enters the top of the cone crusher, it becomes wedged and squeezed between the mantle and the bowl liner or concave. Large pieces of ore or rock are broken and then fall to a lower position (because they are now smaller) where they are broken again. This process continues until the pieces are small enough to fall through a narrow opening at the bottom of the crusher. The crusher head of cone crushers is typically guided by an eccentric assembly to actuate movement of the head for crushing material. It can be appreciated that there are generally two types of cone crusher designs. One in which the concave hopper can be adjusted in position relative to the gyrating spindle to adjust for wear and change product size. The other type is designed such that the gyrating spindle can be raised and lowered.

Gyratory crushers are also well established machines that are used for crushing rocks, ore, and other materials. A gyratory crusher is a cone crusher designed for very large feed. The gyratory crusher is usually the first stage of size reduction equipment in a mining operation. They are very large and their basic structure comprises a bowl shaped as a cone with the wider end of the cone near the top of the crusher. A conical head assembly is located on the axis of the bowl, and the head assembly is oriented so that its smaller dimension is at the top of the crusher. To perform the crushing action gyratory motions are applied to the conical head assembly.

In the typical gyratory crusher, large material is fed into the top of the crusher between the large opening of the bowl and the small end of the head assembly where the volume is largest. The gyration of the head assembly is furnished by an eccentric assembly, the rotation of which is driven by a gear. Vertical support and minor vertical adjustment of the head assembly is furnished by a hydraulic support assembly. These parts are typically located at the bottom of the crusher, and more specifically they are located at the bottom of the conical head assembly. The gyration applies forces that crush the pieces of material, and they fall lower into the reduced space within the bowl as they are reduced in size. Ultimately the material leaves the crusher through openings at the bottom of the crusher.

Gyratory and cone crushers typically have used large bevel gears as the main drive for the eccentric drive. However, large bevel gears are expensive, and typically large bevel gears have a long lead time to manufacture. In addition, it can be appreciated that large bevel gears are difficult to set up for optimum operating condition. Large bevel gears are also designed to be operated at fixed center distances. Since the eccentric assembly typically operates within a bushing with an operating clearance, the bevel gear will not operate at fixed centers and as such performance is not optimum. The large bevel gears also have limited suppliers and require master sets for interchangeability. Large bevel gears are also limited in the reduction ratio (speed change) they can achieve.

Accordingly, it can be would be desirable to replace the traditional bevel gear assembly on the eccentric drive with a small gearbox assembly utilizing a parallel axis main gearset, which can provide better performance, simplify the manufacturing process, provide reduced lead time for manufacturing thereof, can be manufactured by an increased number of manufactures, competitively priced and provides for a simplified installation and adjustment. In addition, master sets will no longer be needed. Also, further savings can be realized in the motor selection due to increased reduction ratios and correspondingly increased motor speeds.

SUMMARY OF THE INVENTION

In accordance with an exemplary embodiment, a gyratory crusher comprises: a bowl shaped as a cone with its wider opening approaching a top of the crusher; a head assembly shaped as a cone, centrally located within the bowl and having its larger diameter at a lower end of the bowl; a cylindrical eccentric assembly including an eccentric central volume in which the main shaft is held so that, as the eccentric assembly rotates, the mainshaft gyrates, with the eccentric assembly rotating about a center hole within a central hub of the crusher; and a ring gear attached to and rotating the eccentric assembly, and wherein the ring gear is driven by a gearbox assembly, which converts a rotational movement of a drive shaft into at least a second rotational movement and a third rotational movement, and which drives the ring gear of the eccentric assembly.

In accordance with another exemplary embodiment, a gearbox assembly for a gyrator and/or cone crusher comprises: a drive shaft gear attached to a distal end of a drive shaft, the drive shaft gear imparting a rotational movement of the drive shaft to a first gearing assembly, the first gearing assembly imparting a second rotational movement to a second gearing assembly, the second gearing assembly imparting a third rotational movement of the second gearing assembly to drive a ring gear, and wherein the ring gear is attached to and rotates an eccentric assembly of the gyratory and/or cone crusher.

In accordance with a further exemplary embodiment, a method of driving a ring gear of an eccentric assembly of a gyratory crusher comprises: imparting a rotational movement of a drive shaft into a first gearing assembly, wherein the first gearing assembly produces a second rotational movement; imparting the second rotational movement of the first gearing assembly into a second gearing assembly, wherein the second gearing assembly produces a third rotational movement; and imparting the third rotational movement of the second gearing assembly to drive a ring gear, wherein the ring gear is attached to and rotates an eccentric assembly of the gyratory crusher.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of crushing devices, such as gyratory crushers, crushing circuits or cone crushers, and methods of making such devices are shown in the accompanying drawings in which.

DETAILED DESCRIPTION OF PRESENT PREFERRED EMBODIMENTS

Figure 1:
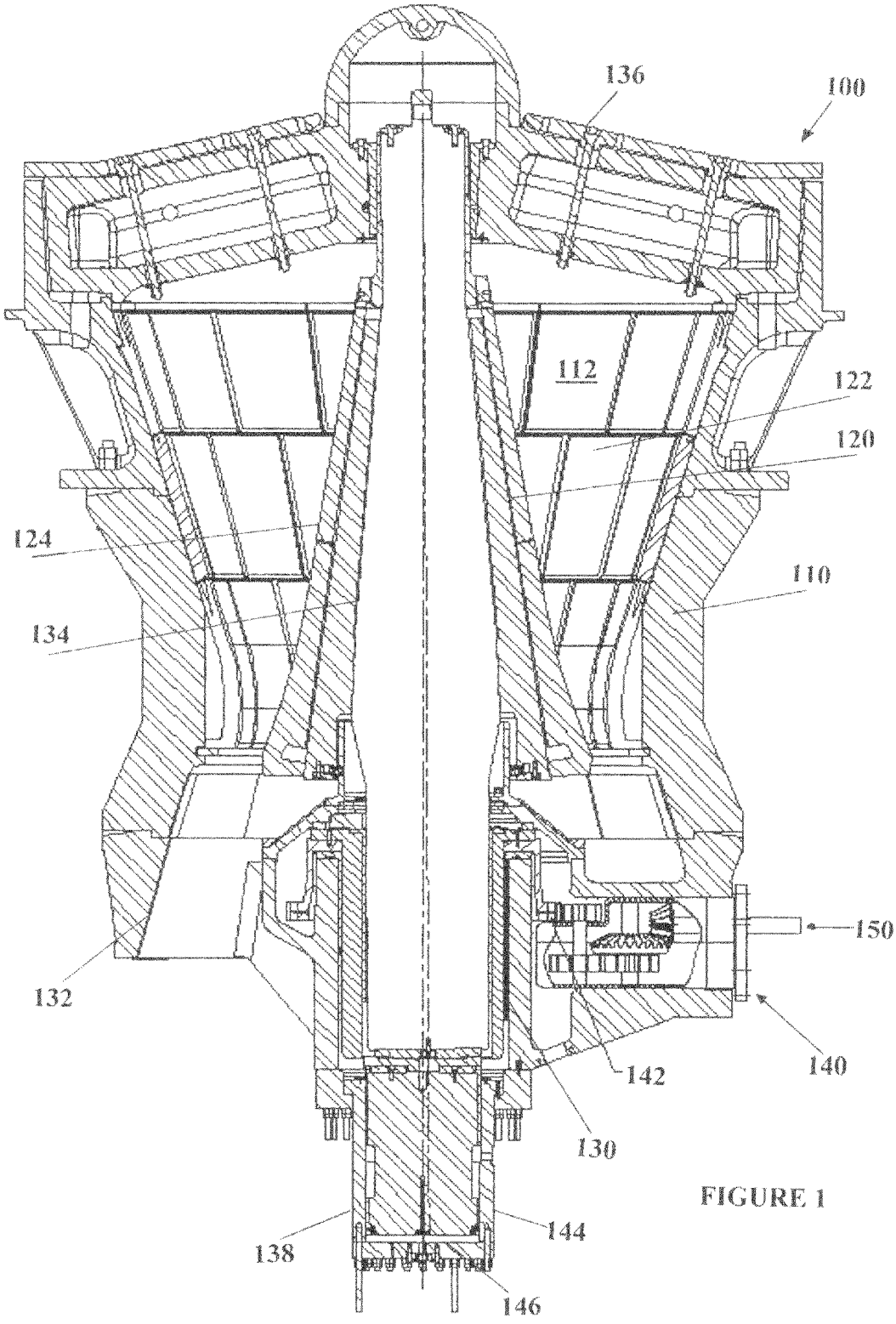
FIG. 1 is a cross sectional view of a gyratory crusher in accordance with an exemplary embodiment.

FIG. 1 is a cross sectional view of a preferred embodiment of gyratory crusher 100 in accordance with an exemplary embodiment. As shown in FIG. 1, the gyrator crusher 100 includes bowl or shell 110 shaped as a cone with its wider opening at the top, and head assembly 120 which is located on an axis inclined relative to the axis of bowl 110. The head assembly 120 is shaped as a cone and has its larger diameter at the lower end of bowl 110 so that together the bowl 110 and the head assembly 120 form crushing volume 122 which is larger at the top and smaller at the lower end. This configuration permits larger material to be fed into the top of crusher 100, and which falls to the bottom of bowl 110 as it is crushed into smaller pieces and exits crusher 100. Typically, both the bowl 110 and the head assembly 120 have replaceable working surfaces. The bowl 110 has a liner 112, called a "concave" in the industry, and head assembly 120 has a liner 124 referred to as a "mantle".

The head assembly 120 is located adjacent to an eccentric assembly 130 which is rotated by a ring gear 142. The ring gear 142 is driven by a gearbox assembly 140 and a drive shaft 150. In accordance with an exemplary embodiment, the eccentric assembly 130, within which the lower portion of a main shaft is held, imparts to the head assembly 120 an eccentric motion, essentially a gyration, for the crusher 100 to function. The motion is imparted to the head assembly 120 by the eccentric assembly 130 that has an eccentric center volume, although the eccentric assembly 130 is itself cylindrical and mounted in a centered cylindrical support hole within a center hub. The eccentric assembly 130 along with annular shell 132, are part of the bottom support structure of crusher 100. The eccentric assembly 130 rotates about a center hole and, as eccentric assembly 130 rotates, its eccentric center volume moves the bottom end of mainshaft 134 in an eccentric path imparting the gyratory motion to head assembly 120.

The mainshaft 134 of head assembly 120 fits into the eccentric assembly 130, and, at the top of the crusher 100, the mainshaft 134 is located by bushings or bearings within a spider (or spider device) 136. The spider (or spider device) 136 is the upper support member of the crusher 100. The mainshaft 134 is supported from below the eccentric assembly 130 by a hydraulic support assembly 138. The hydraulic support assembly 138 is comprised of a cylindrical support 144 and a piston assembly 146.

The eccentric assembly 130 is installed within a cylindrical center hole within a center hub, a top support ring of the eccentric assembly 130 is supported by an eccentric wear ring at the top of center hub. In accordance with an exemplary embodiment, the ring gear 142 is attached to the eccentric assembly 130 by a gear support.

Figure 2:
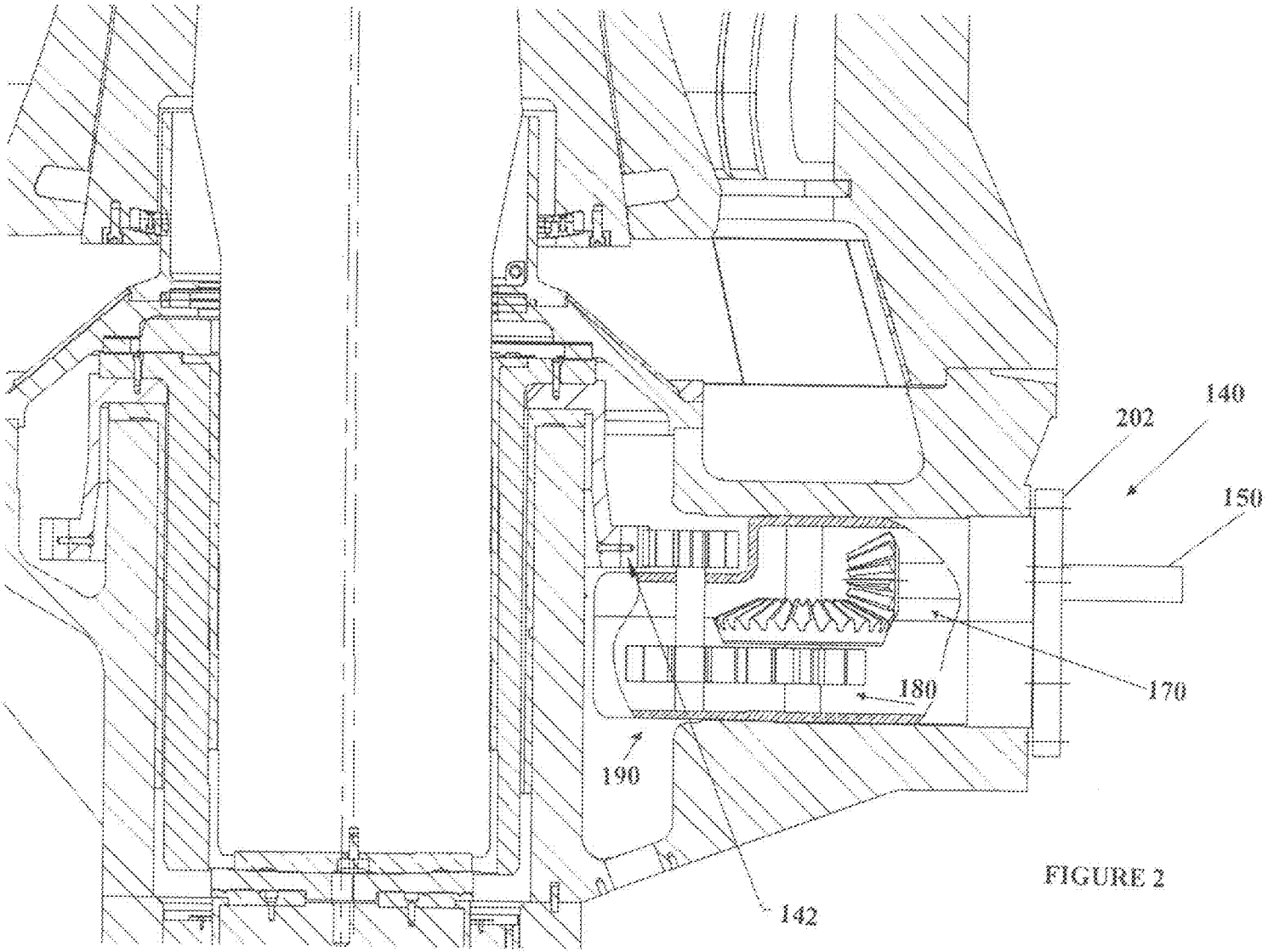
FIG. 2 is a partial cross sectional view of a gyratory crusher in accordance with another exemplary embodiment.
Figure 3:
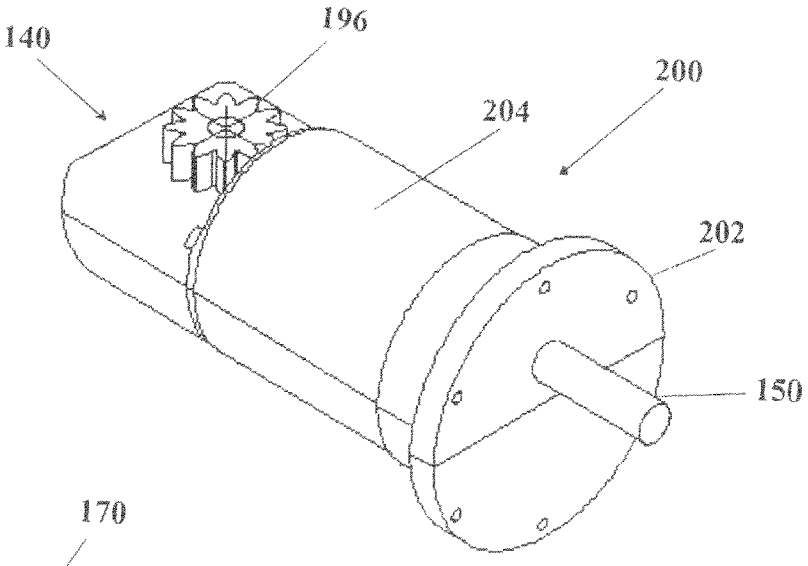
FIG. 3 is a perspective view of a gyratory gearbox in accordance with an exemplary embodiment.

FIG. 2 is a partial cross sectional view of a gyratory crusher 100 showing a gearbox (or gearbox assembly) 140 in accordance with an exemplary embodiment. As shown in FIG. 2, the gearbox assembly 140 includes a drive shaft 150 having a drive shaft assembly 170 attached to a distal end of the drive shaft 150, a first gearing assembly 180, and a second gearing assembly 190. As shown in FIG. 3, the drive shaft assembly 170, the first gearing assembly 180 and the second gearing assembly 190 are preferably housed within a gearbox assembly housing 200. In accordance with an exemplary embodiment, the ring gear 142 is driven by the gearbox assembly 140, which converts a rotational movement of a drive shaft 150 into at least a second rotational movement, which is 90 degrees to the rotational movement of the drive shafts, and which drives the ring gear 142 of the eccentric assembly 130.

A motor or motor arrangement (not shown) is coupled to the drive shaft 150, which generates a first rotational movement of the drive shaft assembly 170. It can be appreciated that the motor or motor arrangement can be integrated within or part of the gearbox housing 200 (FIG. 3). For example, the motor or motor arrangement can be built into or part of the gearbox assembly 140 rather than a separate component.

It can be appreciated that during operation, as shown in FIG. 2, the first rotation movement of the drive shaft assembly 170 imparts a rotational movement to the first gearing assembly 180 (i.e., a second rotational movement to the gearing assembly 140), and which is 90 degrees to the rotational movement of the drive shaft 150. The first gearing assembly 180 then imparts a rotational movement to the second gearing assembly 190 (i.e., a third rotational movement to the gearing assembly 140), which imparts a rotational movement to the ring gear 142, which rotates the eccentric assembly 130. In accordance with an exemplary embodiment, the ring gear 142 is a spur gear (or straight cut gear) having an external gearing assembly.

FIG. 3 is a perspective view of the gyratory gearbox housing 200 in accordance with an exemplary embodiment. As shown in FIG. 3, the gearbox housing 200 includes a base plate 202, an upper housing portion 204, and a lower housing portion 206. The base plate 202 includes an opening sized and configured to receive the drive shaft 150. The upper housing portion 204 and the lower housing portions 206 sized and configured to house the entire first gearing assembly 180 and the second gearing assembly 190, with the exception of a third gear (or a third pinion gear) 196, which imparts a rotational movement to the ring gear 142.

Figure 4:
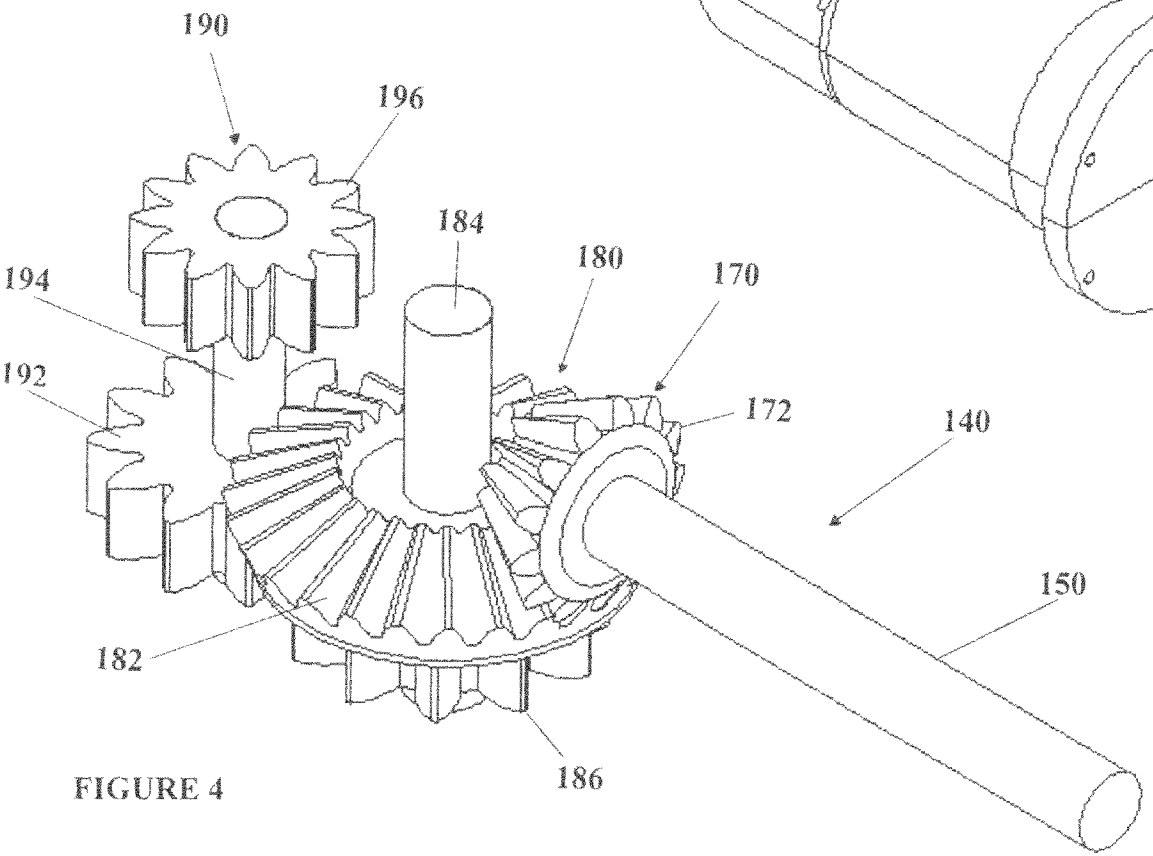
FIG. 4 is a perspective view of the gears of the gyratory gearbox as shown in FIG. 3 in accordance with an exemplary embodiment.

FIG. 4 is a perspective view of the gearing of the gyratory gearbox assembly 140 in accordance with an exemplary embodiment. As shown in FIG. 4, the gearing includes the drive shaft (or rod) 150, which has a drive shaft gear (or first bevel gear) 172 attached to a distal end of the drive shaft 150. The drive shaft gear 172 is preferably a bevel gear, which mates with a first gearing assembly 180, and which includes a corresponding bevel gear (or second bevel gear) 182 to translate the first rotational movement of the drive shaft (or rod) 150 into a second rotational movement between the drive shaft gear 172 and the corresponding bevel gear 182. The corresponding bevel gear 182 is sized and configured to mate with the drive shaft gear 172. In accordance with an exemplary embodiment the drive shaft gear 172 and the matching bevel gear 182 are preferably straight bevel gears (i.e., straight tooth bevel gears), however, it can be appreciated that in accordance with an alternative embodiment, the drive gear 172 and the matching bevel gear 182 can be spiral tooth bevel gears.

The first gearing assembly 180 also includes a drive shaft 184, which is attached to the corresponding bevel gear 182 and a first gear (or first pinion gear) 186. The first gear 186 is preferably a spur gear or straight gear. The first gear 186 has matching teeth to a second gear (or second pinion gear) 192, which is attached to a second rod 194, which drives a third gear (or third pinion gear) 196. The first and second gears 186, 192 translate the second rotational movement into a third rotational movement, which drives the ring gear 142 of the eccentric assembly 130.

Figure 8:
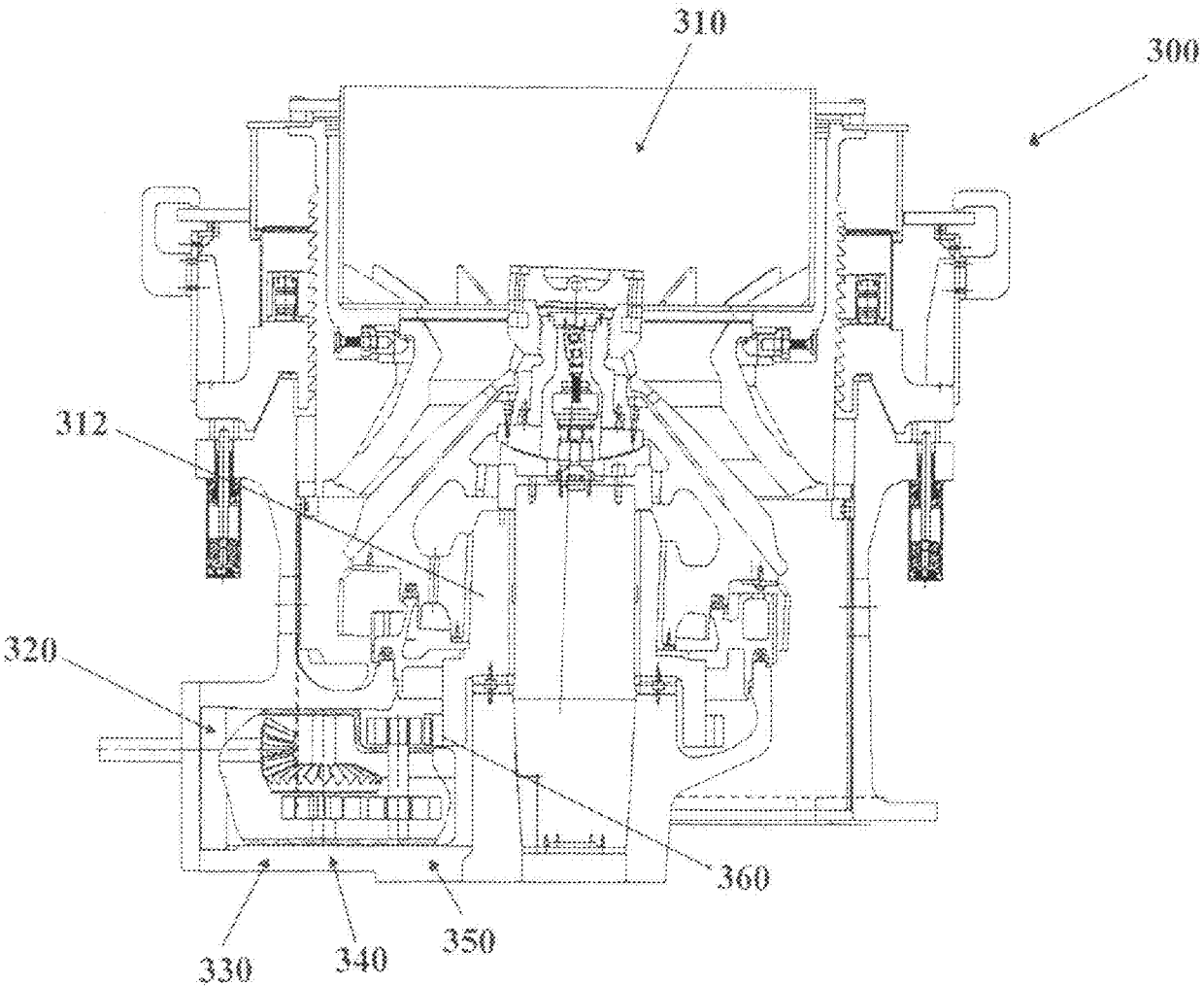
FIG. 8 is a cross sectional view of a cone crusher in accordance with another exemplary embodiment.

It can be appreciated that by using a gearbox assembly 140 as described herein, the motor and/or motor arrangement necessary to drive the ring gear 142 can be much smaller than those required with a large bevel gear as typically used to drive the ring gear 142. For example, in accordance with an exemplary embodiment, the gearing assembly provides a gear ratio of the motor arrangement to the ring gear of at least three to one (3:1), more preferably at least six to one (6:1). As a result of the gearing assembly providing a gear ratio of at least three to one (3:1), the use of higher speed motor arrangements with lower torque can be implemented into the cone crushers as shown in FIGS. 1, 2, and 8.

In addition, it can be appreciated that the large bevel gear that is used to rotate the ring gear 142 can be replaced with a much smaller bevel gear 172, which now operates at fixed mounting distances and a plurality of smaller gears 182, 186, 192, 196. The use of a much smaller bevel gear 172 and the plurality of smaller gears 182, 186, 192, 196 also reduces the costs of the motor and/or motor arrangement. In addition, the use of a much smaller drive shaft gear (i.e., bevel gear 172) and the plurality of smaller gears 182, 186, 192, 196 also provides for more standardized gearing arrangements rather than being dependent on size of the bevel gear, which drives the rotation and the gyration of the head assembly 120.

In accordance another exemplary embodiment, the first and/or second gearing assemblies 180, 190 can include one or more epicyclic gearing or planetary gearing assemblies rather than the plurality of spur and/or pinion gears (i.e., parallel shaft gearing assembly) as shown in FIGS. 1-8.

Figure 5:
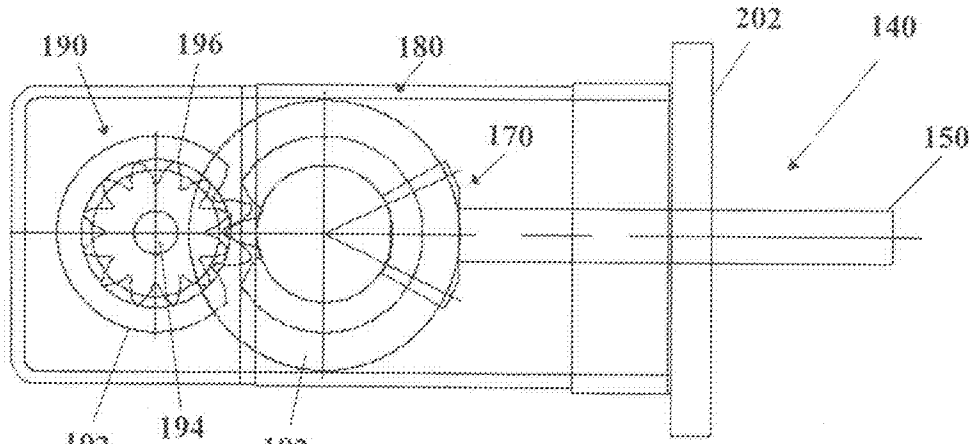
FIG. 5 is top plan view of the gears of a gyratory gearbox in accordance with another exemplary embodiment.

FIG. 5 is top plan view of the gears of a gyratory gearbox 140 in accordance with another exemplary embodiment. As shown in FIG. 5, the gearbox assembly 140 includes the drive shaft 150, which extends outward from the base plate 202 of the housing 200. The housing 200 houses the draft shaft assembly 170, the first gearing assembly 180 and the second gearing assembly 190.

Figure 6:
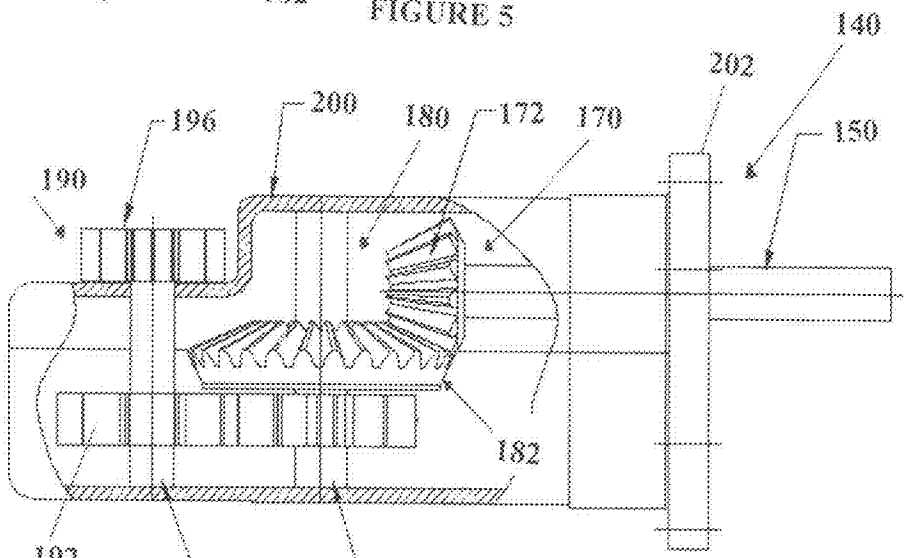
FIG. 6 is side plan view of the gears of a gyratory gearbox in accordance with another exemplary embodiment.

FIG. 6 is side plan view of the gears of a gyratory gearbox 140 in accordance with another exemplary embodiment. As shown in FIG. 6, the drive shaft 150 has a drive shaft gear (or first bevel gear) 172 attached to a distal end of the drive shaft 150. The drive shaft gear 172 is preferably a bevel gear, which mates with a first gearing assembly 180, and which includes a corresponding bevel gear (or second bevel gear) 182 to translate the first rotational movement of the drive shaft (or rod) 150 into a rotational movement between the drive shaft gear 172 and the corresponding bevel gear 182. The corresponding bevel gear 182 is sized and configured to mate with the drive shaft gear 172.

The first gearing assembly 180 also includes a drive shaft 184, which is attached to the corresponding bevel gear 182 and a first gear 186. The first gear 186 has matching teeth to a second gear 192, which is attached to a second shaft 194, which drives a third gear 196. The first and second gears 186, 192 translate the rotational movement of the first gear 186 into a rotational movement of second gear 192, which imparts a rotational movement into the ring gear 142, which rotates the head assembly 120 via the eccentric assembly 130.

Figure 7:
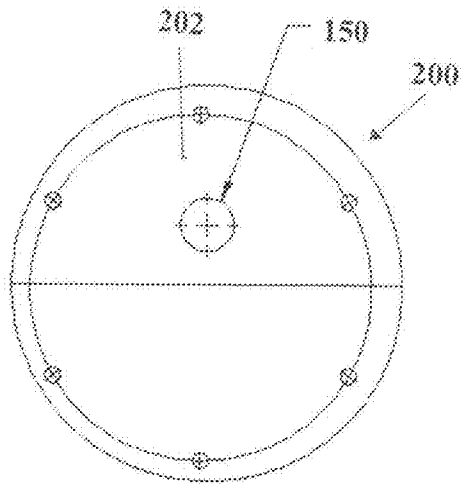
FIG. 7 is an end plan view of the housing of the gyratory gearbox in accordance with a further exemplary embodiment.

FIG. 7 is an end plan view of the housing 200 of the gyratory gearbox 140 in accordance with a further exemplary embodiment. As shown in FIG. 7, the housing 200 includes a base plate 202 upon which the drive shaft 150 extends therethrough.

FIG. 8 is a cross sectional view of a cone crusher (i.e., Symons style) 300 in accordance with another exemplary embodiment. As shown in FIG. 8, the cone crusher 300 includes a housing, which encloses a hopper 310 that has an opening sized and configured to receive material for crushing, such as rock, ore, minerals or stone. The cone crusher 300 also includes a drive assembly 320 that is configured to rotate a gearing assembly 330 (as shown in FIG. 7), which actuates movement of an eccentric assembly 312 to cause the crushing apparatus of the cone crusher 300 to move to crush material. Preferably, the drive assembly 320 is rotated by an electric motor, an engine or other powering device. In accordance with an exemplary embodiment, the eccentric assembly 312 is coupled to the gearing assembly 330.

As shown in FIG. 8, the gearing assembly 330 converts a rotational movement of the drive assembly (or drive shaft) 320 into at least a second rotational movement, which is 90 degrees to the rotational movement of the drive assembly 320, and which drives a gear or gearing assembly 360 attached or coupled to the eccentric assembly 312.

In accordance with an exemplary embodiment, the gearing assembly 330 includes a drive shaft (or rod), which has a drive shaft gear (or first bevel gear) attached to a distal end of the drive shaft. The drive shaft gear is preferably a bevel gear, which mates with a first gearing assembly 340, and which includes a corresponding bevel gear (or second bevel gear) to translate the first rotational movement of the drive shaft (or rod) into a second rotational movement between the drive shaft gear and the corresponding bevel gear. The corresponding bevel gear is sized and configured to mate with the drive shaft gear. In accordance with an exemplary embodiment the drive shaft gear and the matching bevel gear are preferably straight bevel gears (i.e., straight tooth bevel gears), however, it can be appreciated that in accordance with an alternative embodiment, the drive gear and the matching bevel gear can be spiral tooth bevel gears. The first gearing assembly 340 also includes a drive shaft, which is attached to the corresponding bevel gear and a first gear (or first pinion gear). The first gear is preferably a spur gear or straight gear. The first gear has matching teeth to a second gearing assembly 350, which preferably includes a second gear (or second pinion gear), which is attached to a second rod, which drives a third gear (or third pinion gear). The first and second gears translate the second rotational movement into a third rotational movement, which drives the gear (or gearing assembly) 360 attached or coupled to the eccentric assembly 312.

It should be understood that a customer may be provided with a gyratory crusher such as a cone crusher in one sale. Thereafter, a customer may be told of a method of retrofitting that cone crusher or other gyratory crusher to form a cone crusher that includes a gearbox assembly as shown in FIGS. 1-8. The gearbox assembly may be provided by a supplier or may be purchased from the vendor that previously sold the customer the gyratory crusher. It is contemplated that the vendor or the customer may perform the retrofitting.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

What is claimed is:

1. A gyratory crusher comprising:

a bowl shaped as a cone with its wider opening approaching a top of the crusher;

a head assembly shaped as a cone, centrally located within the bowl and having its larger diameter at a lower end of the bowl;

a cylindrical eccentric assembly including an eccentric central volume in which the main shaft is held so that, as the eccentric assembly rotates, the mainshaft gyrates, with the eccentric assembly rotating about a center hole within a central hub of the crusher; and a ring gear attached to and rotating the eccentric assembly, and wherein the ring gear is driven by a gearbox assembly comprising a drive shaft, a drive shaft gear, a first gear set and a second gear set, said gearbox assembly utilizing a rotational movement of the drive shaft to drive the first gear set which has a first gear set shaft and which is configured to have a rotational movement which is 90 degrees to the rotational movement of the drive shaft, said first gear set driving a second gear set which drives the ring gear of the eccentric assembly, said second gear set having a second gear set shaft, wherein the first gear set shaft and the second gear set shaft are parallel to each other.

2. The crusher of claim 1, further comprising a motor arrangement coupled to the drive shaft of the gearbox assembly.

3. The crusher of claim 2, wherein a gear ratio of the motor arrangement to the ring gear is at least three to one.

4. The crusher of claim 1, wherein the drive shaft gear is a first bevel gear attached to a distal end of the drive shaft.

5. The crusher of claim 4 wherein the first gear set includes a second bevel gear, the first gear set drive shaft and a first pinion gear, said second bevel gear translating the rotational movement of the drive shaft gear into a second rotational movement for the first drive shaft and the first pinion gear.

6. The crusher of claim 5, wherein the first pinion gear cooperates with a second pinion gear, which is attached to the second shaft, which second shaft drives a third pinion gear.

7. The crusher of claim 6, wherein the third pinion gear drives the ring gear of the eccentric assembly.

8. The crusher of claim 1, further comprising a housing, which houses the gearbox assembly.

9. A gearbox assembly for a gyratory and/or cone crusher comprising:

a drive shaft, a drive shaft gear, a first gearing assembly having a first gearing assembly shaft and a second gearing assembly having a second gearing assembly shaft, said first gearing assembly shaft and said second gearing assembly shaft being parallel to each other, said drive shaft gear being attached to a distal end of the drive shaft, the drive shaft gear imparting a first rotational movement of the drive shaft to a first gearing assembly, the first gearing assembly translating the first rotational movement into a second rotational movement which is 90 degrees to the rotational movement of the drive shaft, the second gearing assembly translating the second rotational movement into a third rotational movement which drives a ring gear, and wherein the ring gear is attached to and rotates an eccentric assembly of the gyratory and/or cone crusher.

10. The assembly of claim 9, further comprising a motor arrangement coupled to a drive shaft of the gearbox assembly, and wherein the drive shaft imparts the rotational movement to the drive shaft gear.

11. The assembly of claim 9, wherein the first drive shaft gear is a first bevel gear.

12. The assembly of claim 11, wherein the first gearing assembly includes a second bevel gear, which mates with the drive shaft gear and translates the rotational movement of the drive shaft gear into the second rotational movement between the drive shaft gear and the second bevel gear to the first gearing assembly shaft and a first pinion gear.

13. The assembly of claim 12, wherein the first pinion gear cooperates with a second pinion gear, which is attached to the second gearing assembly shaft, which drives a third pinion gear.

14. The assembly of claim 13, wherein the first and second pinion gears translate the second rotational movement into the third rotational movement.

15. The assembly of claim 14, further comprising a housing, which houses the gearbox assembly.

16. The assembly of claim 9, wherein the gearing assembly provides a gear ratio of a motor arrangement to a ring gear of at least three to one.

17. A method of driving a ring gear of an eccentric assembly of a gyratory crusher and/or cone crusher comprising:

imparting a rotational movement of a drive shaft into a first gearing assembly having a first gearing assembly shaft, wherein the first gearing assembly produces a second rotational movement;

imparting the second rotational movement of the first gearing assembly into a second gearing assembly having a second gearing assembly shaft, and wherein the second gearing assembly produces a third rotational movement; and imparting the third rotational movement of the second gearing assembly to drive a ring gear, wherein the ring gear is attached to and rotates an eccentric assembly of the gyratory crusher and/or cone crusher.

18. The method of claim 17, further comprising coupling a motor arrangement to the drive shaft of the gearbox assembly, wherein the motor arrangement imparts the rotational movement to the drive shaft.

19. The method of claim 18, further comprising a gear ratio of the motor arrangement to a ring gear of at least three to one.

* * * * *